US010051929B2

(12) United States Patent
Mandon

(10) Patent No.: US 10,051,929 B2
(45) Date of Patent: Aug. 21, 2018

(54) DECORATIVE OBJECT, SUCH AS AN ITEM OF JEWELLERY, COMPRISING A BODY AND A DECORATIVE ELEMENT FASTENED IN A REVERSIBLE MANNER TO THE BODY

(71) Applicant: ALTESSE, Saint-Martin-de-Valamas (FR)

(72) Inventor: Laurent Mandon, Le Chambon sur Lignon (FR)

(73) Assignee: ALTESSE, Saint-Martin-de-Valamas (FR)

( * ) Notice: Subject to any disclaimer, the term of this patent is extended or adjusted under 35 U.S.C. 154(b) by 0 days.

(21) Appl. No.: 15/610,630

(22) Filed: Jun. 1, 2017

(65) Prior Publication Data

US 2017/0347762 A1 Dec. 7, 2017

(30) Foreign Application Priority Data

Jun. 3, 2016 (FR) ..... 16 00900
Aug. 30, 2016 (FR) ..... 16 01279
Feb. 8, 2017 (FR) ..... 17 00140

(51) Int. Cl.

| | |
|---|---|
| ***A44C 1/00*** | (2006.01) |
| ***A44C 13/00*** | (2006.01) |
| ***A44C 5/00*** | (2006.01) |
| ***A44C 9/00*** | (2006.01) |

(52) U.S. Cl.

CPC ..... *A44C 13/00* (2013.01); *A44C 1/00* (2013.01); *A44C 5/0007* (2013.01); *A44C 9/0084* (2013.01); *A44D 2201/12* (2013.01)

(58) Field of Classification Search

CPC .. A44B 9/12; A44B 9/125; A44B 9/14; A44B 9/16; A44B 9/18; A44C 13/00; A44C 1/00; A44C 5/0007; A44C 9/0084; A44D 2201/12; Y10T 24/4501; Y10T 24/45016; Y10T 24/45005; F16B 5/0642; F16B 5/0657

USPC ..... 63/43; 132/275, 276, 278, 279; 24/DIG. 31, DIG. 32, DIG. 33; 248/649, 248/689

See application file for complete search history.

(56) References Cited

U.S. PATENT DOCUMENTS 1,396,311 A * 11/1921 Basley ..... A44B 9/12 24/708.8
1,660,181 A * 2/1928 Voskerchian ..... A44C 1/00 63/20
5,337,583 A * 8/1994 Giles ..... F01D 9/023 24/573.09

* cited by examiner

*Primary Examiner* — Jack W Lavinder
(74) *Attorney, Agent, or Firm* — Joseph G. Chu; JCIP

(57) ABSTRACT

The invention proposes a decorative object comprising a body and a decorative element fastened in a reversible manner to the body, enabling change of decorative element easily. The decorative object comprising a system for reversibly fastening the decorative element on the body comprises: on the decorative element, a first locking stud on which is pivotably mounted a rigid stem; a second locking stud provided with a means for reversibly locking the stem in fastening position; on the body: a first locking orifice intended to receive the first locking stud of the decorative element; a second locking orifice intended to receive the second locking stud of the decorative element; a bearing surface being arranged, in fastening position, between the two locking studs, and on which the stem is intended to bear forcibly when it is locked in fastening position by the means for reversibly locking the second locking stud.

13 Claims, 5 Drawing Sheets

Fig. 13
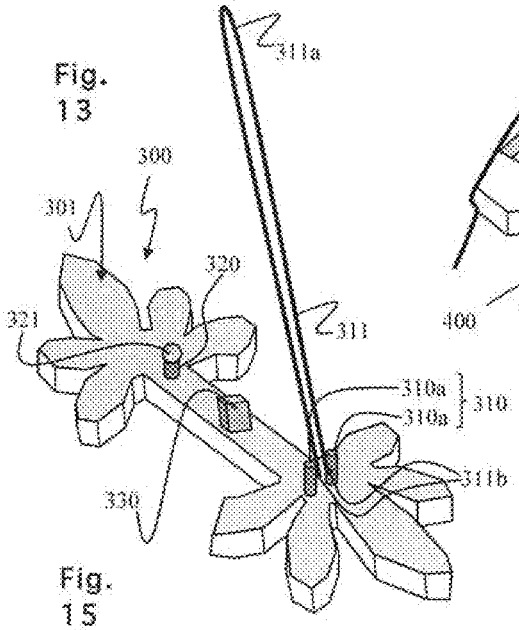
Fig. 14
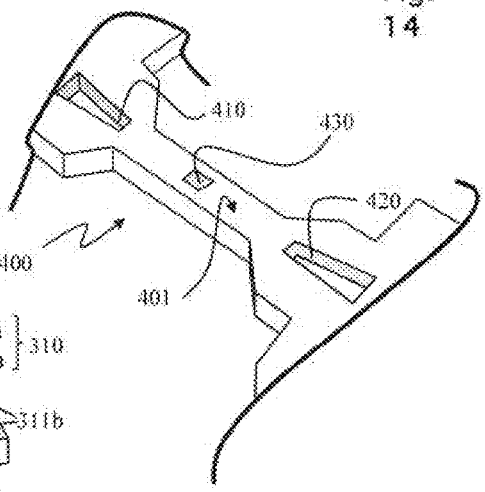
Fig. 15
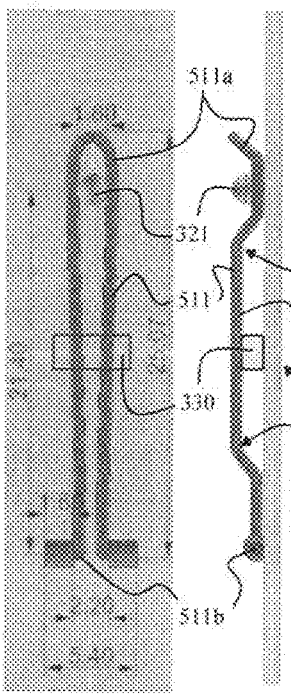
Fig. 16
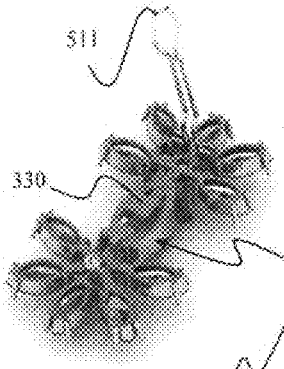
Fig. 17
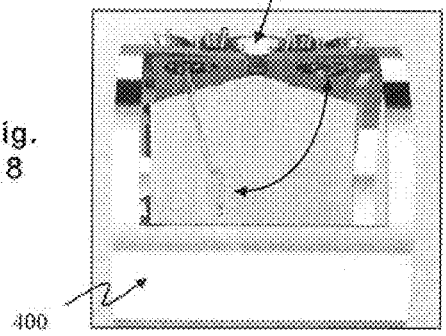
Fig. 18

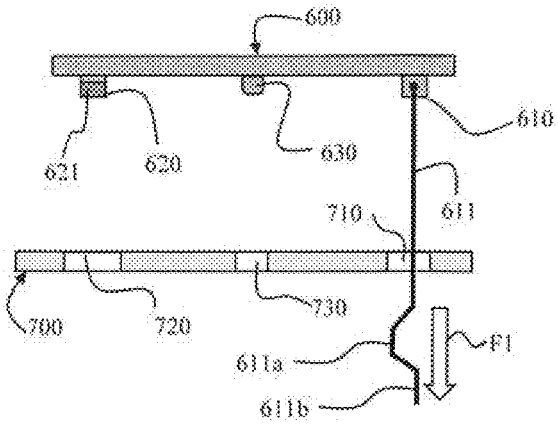
Fig. 19
Fig. 20
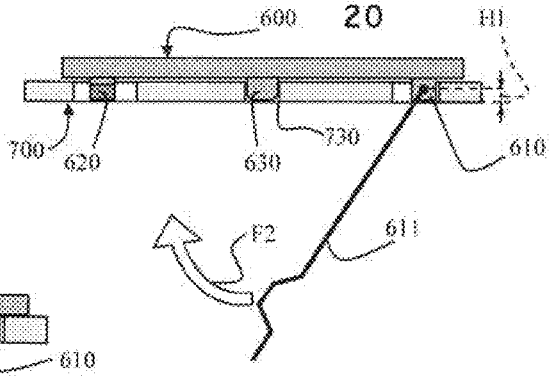
Fig. 21
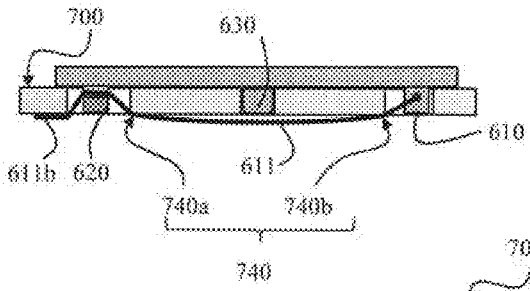
Fig. 22
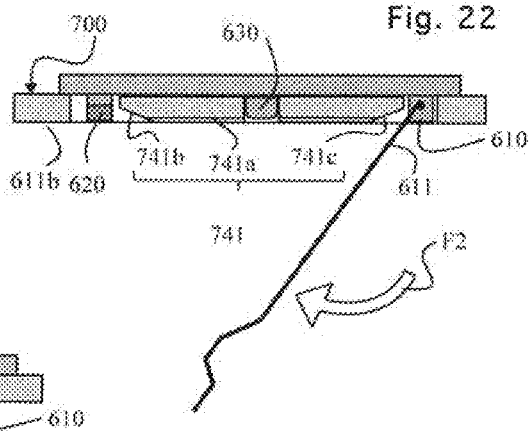
Fig. 23
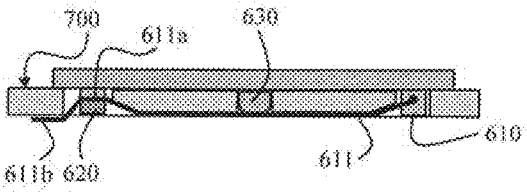

DECORATIVE OBJECT, SUCH AS AN ITEM OF JEWELLERY, COMPRISING A BODY AND A DECORATIVE ELEMENT FASTENED IN A REVERSIBLE MANNER TO THE BODY

This application claims priority to the French Patent Application Nos. 1600900 filed on Jun. 3, 2016, 16001279 filed on Aug. 30, 2016, and 1700140 filed on Feb. 8, 2017, the contents of which are incorporated by reference in their entirety herein.

BACKGROUND OF THE INVENTION

The invention relates to a decorative object, such as an item of jewelry, comprising a body and a decorative element fastened in a reversible manner to the body.

A decorative object, such as an item of jewelry, generally has a body supporting the decorative element (s), such as crystals, gemstones, precious metal patterns, a watch, etc.

The body is generally shaped to be positioned on the user: it has for example a hoop shape for a ring or a wristlet shape for a bracelet.

Alternatively, the body may be shaped to be fastened on another object borne by the user, such as a bag. It is then possible to fasten the decorative element (s) on the bag.

The trend is to be able to personalise fashion accessories to adapt them, for example, to the clothes worn, to the types of activities planned, or to a need for frequent renewal so as not to repeat a same decoration. The simplest solution is to propose numerous variants of a same item of jewelry.

However, this introduces an important cost for users and an important consumption of raw material.

BRIEF SUMMARY OF THE INVENTION

One objective of the invention is to propose a decorative object, such as an item of jewelry, comprising a body and a decorative element fastened in a reversible manner to the body, so as to be able to change easily (that is to say without a tool) the decorative element while conserving the same body.

This makes it possible to economise the raw material of the body, which enables the consumer to be able to acquire several decorative elements to assemble them to the body as a function of his or her desires at the time.

Another objective of the invention is to propose such a decorative object, while ensuring that the aesthetic of the item of jewelry is conserved, that is to say ensuring that the fastening system enables a regular, precise and immediate alignment of the decorative element on the item of jewelry (or more generally on the decorative object). In other words, the user does not have to be concerned with positioning when fastening the decorative element in order that it is in the position prescribed by the manufacturer.

Reversible fastening is taken to mean a fastening that can be done and undone without a tool. On the contrary, permanent fastening is taken to mean a fastening requiring a tool in order to be done or undone (crimping, screwing, bonding, etc.).

To this end, the invention relates to a decorative object, such as an item of jewelry, comprising a body and a decorative element fastened to the body, the decorative object comprising a system for reversibly fastening the decorative element on the body comprising:

On the decorative element:

- A first locking stud on which is pivotably mounted a rigid stem;

- A second locking stud provided with a means for reversibly locking the stem in fastening position;

On the body:

- A first locking orifice intended to receive the first locking stud of the decorative element;
- A second locking orifice intended to receive the second locking stud of the decorative element;

a bearing surface being arranged, in fastening position, between the two locking studs, such that the stem forcibly bears against it when said stem is locked in fastening position by the means for reversibly locking the second locking stud.

According to particular embodiments:

- the bearing surface may be borne by the body;
- the bearing surface of the body may have a groove for receiving the stem when the latter is locked in fastening position by the reversible locking means, in such a way that the stem is flush at least in part.
- the bearing surface may be borne by a bearing stud arranged, in fastening position, between the two locking studs and aligned therewith, and on which the stem is intended to bear forcibly when it is locked in fastening position by the means for reversibly locking the second locking stud;
- the bearing stud may be integral with the decorative element of the decorative object and arranged between the two locking studs and aligned therewith, the body comprising an intermediate orifice intended to receive the bearing stud, the intermediate orifice being arranged between the two locking orifices and aligned therewith;
- the bearing stud may be integral with the body of the decorative object and arranged between the two locking orifices and aligned therewith;
- the bearing stud may have a height such that the stem is elastically deformed on the bearing stud when the stem is engaged in the means for reversibly locking the second locking stud;
- the bearing stud may comprise a bearing surface of the stem provided with a groove for laterally maintaining the stem when it bears on the bearing stud;
- the stem may have a rectilinear part provided with a free end, and a fastening part pivoting on the first locking stud, said pivoting part being constituted by:
  - At least one lateral offset segment forming an angle with respect to the rectilinear part;
  - A segment of axis of rotation arranged in the extension of the lateral offset segment and perpendicularly to the rectilinear part;
  - A locking segment arranged in the extension and perpendicularly to the segment of axis of rotation;
- the stem may be constituted of a strand bent back on itself, so as to form a reversible fastening loop on the second locking stud, each free end of the strand being pivotably fastened on a portion of the first locking stud; and/or
- the rigid stem may comprise, between a free end and a pivoting fastening part, two elbows that are the reverse of each other.

The invention also relates to a decorative element for a preceding decorative object, the decorative element comprising a decorative part and a part for fastening to the decorative object, the fastening part comprising:

- A first locking stud on which is pivotably mounted a rigid stem;
- A second locking stud provided with a means for reversibly locking the stem in fastening position.

Alternatively, the decorative element may comprise a decorative part and a part for fastening to the decorative object, the fastening part comprising:

A first locking stud on which is pivotably mounted a rigid stem;

A second locking stud provided with a means for reversibly locking the stem in fastening position;

A bearing stud arranged between the two locking studs and aligned therewith.

The invention also relates to a decorative kit for a preceding decorative object, which comprises at least two preceding decorative elements and each bearing different decorations.

The invention also relates to a method for assembling a decorative element of a preceding decorative object, characterised in that it comprises the following steps:

a) if needs be, freeing the stem of the locking means from the second locking stud;

b) engaging the free end of the stem in one of the locking orifices of the body;

c) engaging the two locking studs in the locking orifices of the body until the decorative element is against the body;

d) pivoting the stem towards the second locking stud in such a way that it bears on the bearing surface;

e) elastically deforming the stem on the bearing surface to engage the stem in the means for locking the second locking stud.

Step c) may further comprise the engagement of the bearing stud in the intermediate orifice.

BRIEF DESCRIPTION OF THE DRAWINGS

Other characteristics of the invention will be set forth in the description detailed hereafter, made with reference to the appended drawings, which represent, respectively:

FIG. 13, a schematic view in perspective of a third embodiment of a decorative element for an item of jewelry according to the invention in open position;

FIG. 14, a partial schematic view in perspective of the body of the item of jewelry according to the invention complementary to the decorative element of FIG. 13;

FIGS. 15 to 18, schematic views in perspective of a variant of the third embodiment of a decorative element for an item of jewelry according to the invention.

FIGS. 19 to 21, schematic views in section of the mounting method of a first variant of a fourth embodiment of an item of jewelry according to the invention; and FIGS. 22 and 23, schematic views in section of the mounting method of a second variant of a fourth embodiment of an item of jewelry according to the invention.

DETAILED DESCRIPTION OF THE PREFERRED EMBODIMENTS

Figure 1:
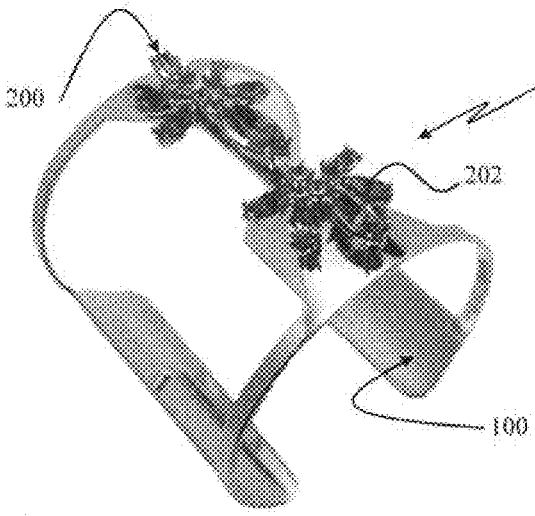
FIG. 1, a schematic view in perspective of an item of jewelry according to the invention, comprising a body and a decorative element fastened to the body.

The invention aims to propose a decorative object, such as the item of jewelry 1 illustrated in FIG. 1.

Figure 3:
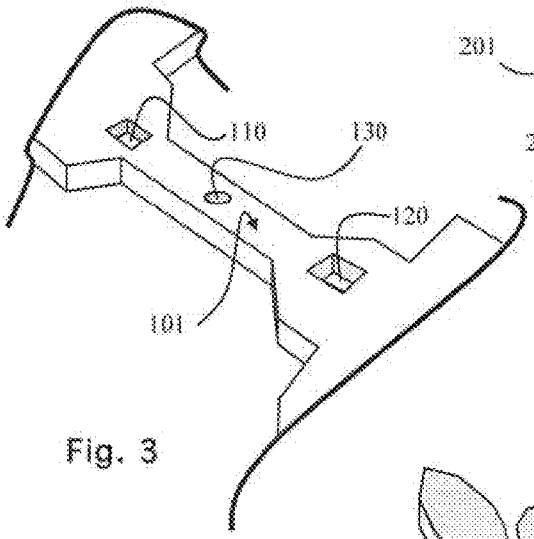
FIG. 3, a partial schematic view in perspective of the body of the item of jewelry according to the invention.
Figure 2:
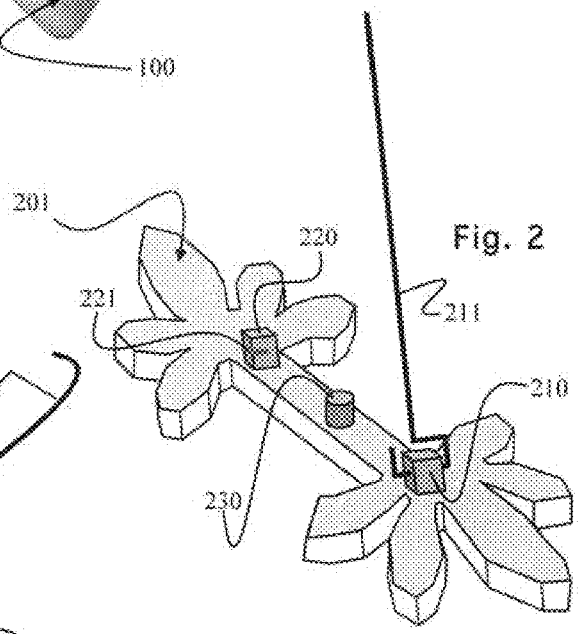
FIG. 2, a schematic view in perspective of a first embodiment of a decorative element for an item of jewelry according to the invention in open position.

This object 1 comprises a body 100 and a decorative element 200 fastened to the body in a reversible manner by a reversible fastening system of which a first embodiment is illustrated in FIGS. 2 and 3.

FIG. 2 illustrates the part for fastening 201 the decorative element 200 on the body 100, in particular on the fastening zone 101 of the body 100. The decorative part 202 of the decorative element is not visible in this figure but in FIG. 1.

FIG. 3 illustrates the fastening zone 101 of the body 100 in which the decorative element 200 is fastened.

The part of the fastening system present on the decorative element 200 comprises:

A first locking stud 210 on which is pivotably mounted a rigid stem 211; and A second locking stud 220 provided with a means for reversibly locking 221 the stem in fastening position, for example a fastening slot into which the stem 211 will be slid.

The part of the fastening system present on the body 100 comprises:

A first locking orifice 110 intended to receive the first locking stud 210 of the decorative element 200;

A second locking orifice 120 intended to receive the second locking stud 220 of the decorative element 200.

In a general manner, according to the invention, the fastening system also comprises a bearing stud arranged between the two locking studs and aligned therewith, in fastening position (that is to say when the studs 210-220 of the decorative element are engaged in the orifices 110-120 of the body and when the stem 211 is in contact with the locking means 221).

In the embodiment illustrated in FIGS. 3 to 5*c*, the bearing stud 230 is integral with the decorative element 200. It is arranged between the two locking studs 210-220 and aligned therewith.

In a complementary manner, the body 100 comprises an intermediate orifice 130 intended to receive the bearing stud 230, the intermediate orifice 130 being arranged between the two end orifices 110-120 and aligned therewith.

In fastening position, the stem is intended to bear forcibly on the bearing stud 230 when the stem is locked in fastening position by the means for reversibly locking 221 the second locking stud 220.

Figure 4:
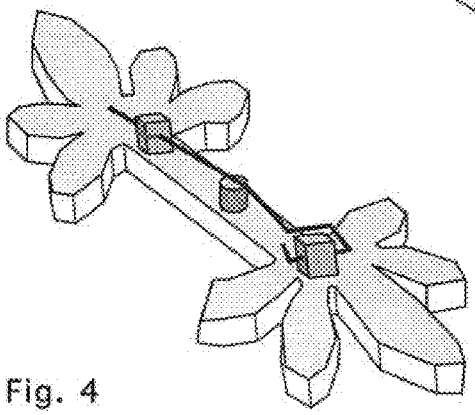
FIG. 4, a schematic view in perspective of the embodiment of FIG. 2 in closed position.

This is illustrated in FIG. 4, in which the body 100 has not been illustrated so as not to overload the figure.

Figure 6:
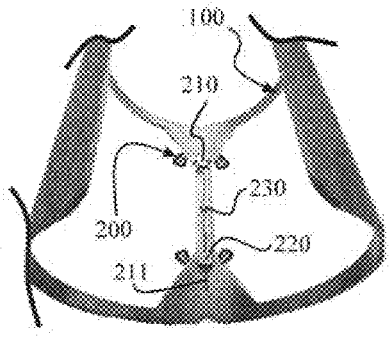
FIG. 6, a schematic view in perspective of an item of jewelry according to the invention after assembly.

This assembly is also illustrated in FIG. 6, in which the body has also been represented partially.

Figure 5A:
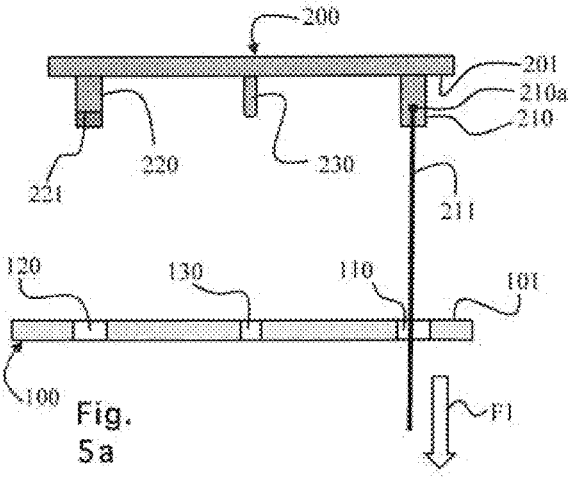
FIGS. 5*a*, 5*b* and 5*c*, schematic views in section of the mounting method of the first embodiment of an item of jewelry according to the invention.
Figure 5B:
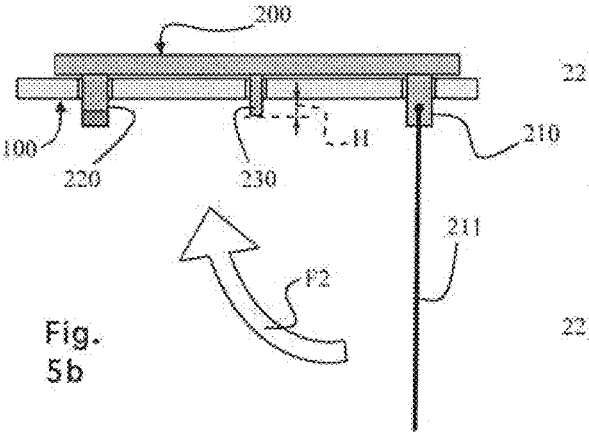
Figure 5C:
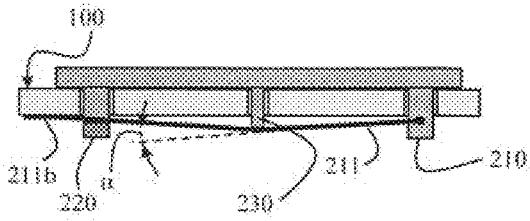

FIGS. 5*a* to 5*c* illustrate the method for assembling the decorative element 200 on the body 100 of a decorative object.

In FIG. 5*a*, the user engages the free end 211*a* of the stem 211 in one of the locking orifices 110 of the body. If needs be, the user will have freed beforehand the stem 211 from the locking means 221 of the second locking stud 220.

Then the user brings the decorative element 200 closer to the body 100, in the direction of the arrow F1, and engages the two locking studs 210-220 in the locking orifices 110-120 of the body 100 until the decorative element is against the body (FIG. 5*b*). In the embodiment illustrated, this step further comprises the engagement of the bearing stud 230 in the intermediate orifice 130.

The locking studs 210-220 are thus suited to cooperating with the locking orifices of the body 100 of the decorative object in order to enable a very precise positioning, in use, of the decorative element on the body of the decorative object, while enabling an easy change of the decorative element.

The fastening position of the decorative element is thus precise because it is determined by the cooperation of the studs and the locking orifices.

It is thus possible, for example, to fasten in a reversible, precise and solid manner a brooch of gemstones on a support such as a ring or a bracelet. Also, it is possible to fasten in a reversible, precise and sure manner a watch on a support fastened to a bag.

The user then pivots the stem 211 in the direction of the arrow F2, towards the second locking stud 220 in such a way that it bears on the bearing stud 230.

Then, the user elastically deforms the stem 211 on the bearing stud 230 to engage the stem in the means for locking 221 the second locking stud 220. For example, the user slides the stem 211 into a locking slot borne by the locking stud 220. It is thus understood that "rigid stem" is taken to mean, according to the invention, that the stem can be elastically deformed by a user, without use of a tool, while providing a stress when said stem is deformed and in contact with the locking means 221.

Advantageously, the locking orifices have a shape complementary to the shape of the locking studs, and a dimension that is just superior in order to limit lateral play between the studs and the orifices.

Alternatively, or in combination, the intermediate orifice 130, when it is present, has a shape complementary to the shape of the bearing stud, and a dimension that is just superior in order to limit lateral play between the bearing stud and the intermediate orifice.

This enables a very precise reversible fastening in position of the decorative element on the body of the decorative object, while enabling an easy change of the decorative element.

The fastening position of the decorative element is thus precise because it is determined by the cooperation of the studs and the locking orifices.

In other words, the user does not have to be concerned with alignment when fastening the decorative element on the body of the decorative object in order that the decorative element is in the position prescribed by the manufacturer.

Preferably, the studs and the orifices have a cylindrical polyhedral shape (for example triangular, square, rectangular, hexagonal, etc.) and non-circular. In this way, the decorative element is translationally but also rotationally locked. The forcible fastening of the stem finally locks the decorative element on the body.

According to the invention, the bearing stud has a height H such that the stem 211 is elastically deformed on the bearing stud 230 when the stem 211 is engaged in the means for reversibly locking 221 the second locking stud 220.

In this way, the stem 211 has a curve of angle $\alpha$. This curvature exerts a stress on the locking stud 220 and prevents the stem 211 from disengaging from the locking means 221.

In this embodiment, the stem 211 advantageously has a sufficient length so that its free end 211*b* bears (see FIG. 5*c*) on the body 100 when it is forcibly engaged in the locking means 221. This contact limits the relative movement of the decorative element 200 and the body 100, which makes the assembly more qualitative.

This forcible layout makes it possible to lock the decorative element on the body, without necessity of providing a return means, of spring type, at the level of the fastening of the stem on the first locking stud 210.

Moreover, the force is shifted nearer to the locking means than if the stem was pivotably mounted on a spring at the level of the first locking stud 210. The stress is thus greater and the risks of disengagement of the stem from the locking means 221 are reduced.

Figure 7:
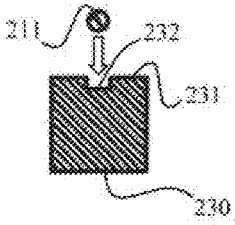
FIG. 7, a schematic view in section of an advantageous embodiment of a bearing stud of a decorative element for an item of jewelry according to the invention.

Advantageously, as illustrated in FIG. 7, the bearing stud 230 comprises a bearing surface 231 of the stem 211 provided with a groove for laterally maintaining 232 the stem 211 when it bears on the bearing stud 230.

Figure 8:
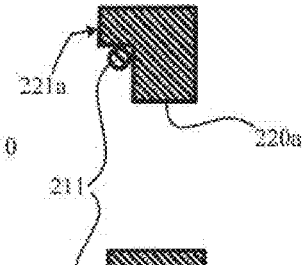
FIGS. 8 and 9, schematic views in section of two embodiments of a means for locking the second fastening stud of a decorative element for an item of jewelry according to the invention.

FIG. 8 illustrates a first variant 221*a* of the means for locking the second locking stud 220*a*.

The locking means 221*a* is constituted by a lateral rim directly in line under which the stem 211 is slid in order to be maintained by the stress exerted on the stem 211 by the bearing stud 230.

Figure 9:
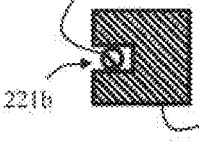

FIG. 9 illustrates a second variant 221*b* of the means for locking the second locking stud 220*b*.

The locking means 221*b* is constituted by a lateral notch into which the stem 211 is slid in order to be maintained by the stress exerted on the stem 211 by the bearing stud 230.

Figure 10A:
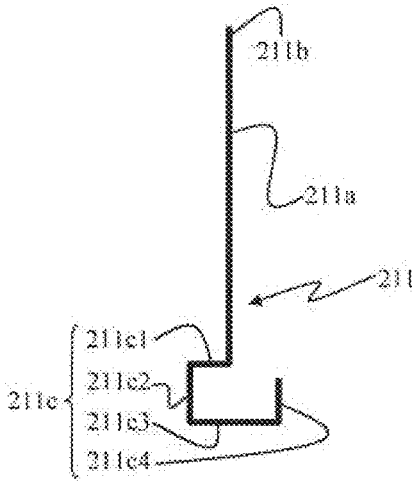
FIGS. 10*a* and 10*b*, schematic views in plane of two embodiments of a fastening stem of a decorative element for an item of jewelry according to the invention.

FIG. 10*a* illustrates an advantageous embodiment of the stem 211. The latter has:

- a rectilinear part 211*a* provided with a free end 211*b*, and
- a fastening part 211*c* pivoting on the first locking stud 210, The pivoting part 211*c* is advantageously produced by folding of the other end of the stem 211, in order to obtain:

- At least one lateral offset segment forming an angle with respect to the rectilinear part; the embodiment illustrated comprises two lateral offset segments 211*c*1 and 211*c*2;
- A segment of axis of rotation 211*c*3 arranged in the extension of the lateral offset segment 211*c*1-211*c*2 and perpendicularly to the rectilinear part 211*a;*
- A locking segment 211*c*4 arranged in the extension and perpendicularly to the segment of axis of rotation 211*c*3.

This embodiment of the stem is particularly advantageous because it is both inexpensive and very practical.

It suffices to thread it into the transversal pivot hole 210*a* of the stud 210 of the locking segment 211*c*4, then to make it pivot to engage the segment of axis of rotation 211*c*3 in the transversal pivot hole 210*a*. In this position, the locking segment 211*c*4 and the lateral segment 211*c*2 prevent the stem 211 from coming free from the stud 210.

Since it is the bearing stud that generates the stress of the stem during locking, it is not necessary that the stem itself comprises an elastic return structure such as one or more spring loops.

Figure 10B:
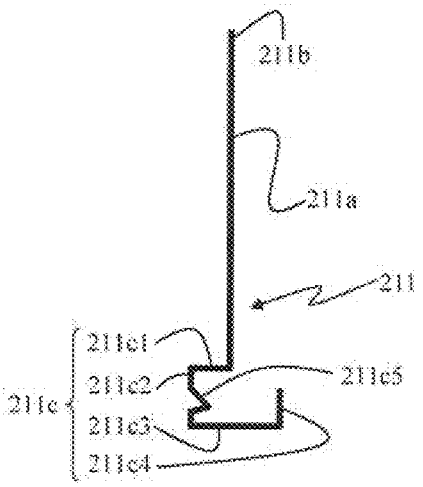

According to a preferred embodiment illustrated in FIG. 10*b*, compatible with all of the embodiments of a decorative object according to the invention, the lateral offset segment 211*c*2 has a fold 211*c*5 that is non-coplanar with the remainder of the stem 211, and shaped to be stressed when bearing against the body 100 when the stem 211 is forcibly engaged in the locking means 221. This contact increases the pinning force between the decorative element 200 and the body 100, which makes the assembly more qualitative (see FIG. 12).

Alternatively, the locking segment 211*c*4 may be non-coplanar with the remainder of the stem and sufficiently long to have a point of forcible contact against the body of the decorative object according to the invention when the stem 211 is forcibly engaged in the locking means 221.

Figure 11A:
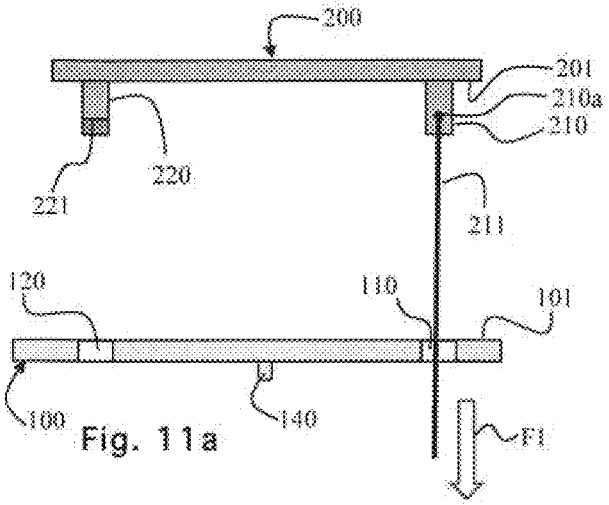
FIGS. 11*a*, 11*b* and 11*c*, schematic views in section of the mounting method of a second embodiment of an item of jewelry according to the invention.
Figure 11B:
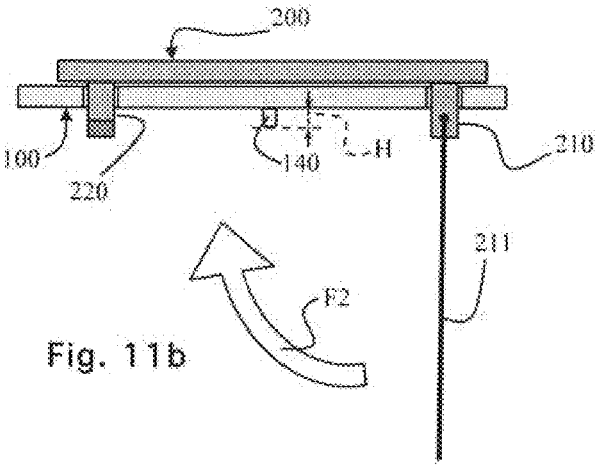
Figure 11C:
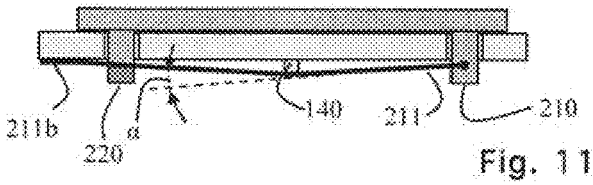

A second embodiment is illustrated in FIGS. 11*a* to 11*c*. In this embodiment, the bearing stud 140 is integral with the body 100 of the decorative object 1 and not with the decorative element 200.

The bearing stud 140 is then arranged on the body 100, between the two locking orifices 110 and 120 and aligned therewith.

The other characteristics of the bearing stud 230 of the first embodiment described previously are also valid for the bearing stud 140 of the second embodiment: height to obtain stress locking of the stem 211 by the means for locking 221 the second locking stud 200, notch 232, etc.

This embodiment in which the bearing stud is on the body and not on the decorative element has the advantage of better pinning the decorative element 200 against the body 100. In a complementary manner, the stem 211 may advantageously have a sufficient length so that its free end 211*b* bears (see FIG. 11*c*) on the body 100 when it is forcibly engaged in the locking means 221. This contact increases the pinning force between the decorative element 200 and the body 100, which makes the assembly more qualitative.

Figure 12:
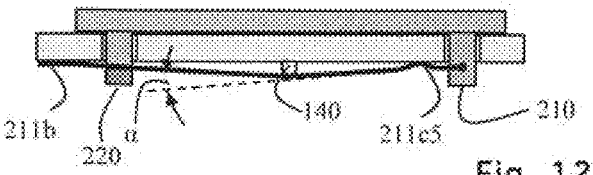
FIG. 12, a schematic view in section of a variant of the end of the mounting method of FIG. 11*c* with a stem according to FIG. 10*b;*

In a complementary manner, as illustrated in FIG. 12, the stem 211 may advantageously have a pivoting part 211*c* provided with a particular structure such that this pivoting part has a forcible point of contact against the body of the decorative object according to the invention when the stem 211 is forcibly engaged in the locking means 221. This particular structure may advantageously be the folds 211*c*5 of the stem 211 of FIG. 10*b*.

This embodiment of the stem 211 is also valid for the embodiment of the invention illustrated in FIGS. 5*a* to 5*c*.

The invention also pertains to a decorative kit for a decorative object according to the invention, comprising at least two decorative elements 200 each bearing different decorations. The user may then choose to purchase this kit for his or her decorative object in order to change only the decorative element to have a different decoration, without having to change the whole of his or her decorative object (item of jewelry, for example), that is to say without having to repurchase the body of the decorative object.

Advantageously, the body, the decorative element, the stem and the studs are metal.

FIGS. 13 and 14 illustrate another exemplary embodiment of the invention showing different variants of the different elements that may be envisaged without going beyond the scope of the invention.

FIG. 13 shows a part for fastening 301 the decorative element 300 on the body 400 (see FIG. 14), in particular on the fastening zone 401 of the body 400. The decorative part 3 of the decorative element is not visible in this figure.

FIG. 14 illustrates the fastening zone 401 of the body 400 in which the decorative element 300 must be fastened.

The part of the fastening system present on the decorative element 300 comprises:

- A first locking stud 310 on which a rigid stem 311 is pivotably mounted; and
- A second locking stud 320 provided with a means for reversibly locking 321 the stem in fastening position, for example a fastening ball under which the stem 311 will be slid.

In this embodiment, the rigid stem 311 is constituted of a strand bent back on itself, so as to form a loop 311*a* for reversibly fastening on the second locking stud 320 (the loop 311*a* is inserted forcibly and in a reversible manner under the ball 321).

The first locking stud 310 is constituted of two separate portions 310*a*, on each of which a free end 311*b* of the strand is pivotably fastened.

The part of the fastening system present on the body 400 comprises:

- A first locking orifice 410 intended to receive the first locking stud 310 of the decorative element 400;
- A second locking orifice 420 intended to receive the second locking stud 320 of the decorative element 300.

In this exemplary embodiment, the locking orifices 410-420 do not have a shape complementary to the shape of the locking studs 310-320. They simply enable the passage of the stem 311 and the locking studs 310-320 with a view to the locking of the decorative element on the body of the object.

In order to guarantee a precise fastening position of the decorative element, the bearing stud 330, integral with the decorative element 300, has a cylindrical polyhedral shape (for example triangular, square, rectangular, hexagonal, etc.) and thus non-circular. In a complementary manner, the body 400 comprises an intermediate orifice 430 of complementary shape (and thus not circular) and of dimension that is just superior in order to limit lateral play between the bearing stud 330 and the intermediate orifice 430.

This enables a very precise reversible fastening in position of the decorative element on the body of the decorative object, while enabling an easy change of the decorative element.

The fastening position of the decorative element is thus precise because it is determined by the cooperation of the bearing stud and the intermediate orifice.

In other words, the user does not have to be concerned with alignment when fastening the decorative element on the body of the decorative object in order that the decorative element is in the position prescribed by the manufacturer.

FIGS. 15 to 18 illustrate a variant of the third embodiment of a decorative element for an item of jewelry according to the invention, a variant which may also be adapted to the first and second embodiments.

This variant illustrates the fact that the rigid stem 511 may comprise, between the free end 511*a* and the pivoting fastening part 511*b*, two elbows 511*c*-511*d* that are the reverse of each other to facilitate the fastening of the free end while ensuring the forcible bearing of the part 511*e* of the stem situated between the two elbows on the bearing stud 330.

Thanks to these two elbows, the stem is stressed just sufficiently to be elastically deformed when it is reversibly fastened to the second locking stud 321 and bearing on the bearing stud 330. Thus, when the stem is unfastened from the locking stud 321, it recovers its initial shape without residual deformation, which ensures over time the integrity of the stem and the efficiency of the fastening.

The relative position of the decorative element 300 on the body 400 is ensured by the polygonal shape (triangular, square, pentagonal, etc.) of the bearing stud 330 and its correct adjustment in the intermediate orifice 430.

Thus, in a general manner, according to the invention, the decorative element comprises a so-called decorative "outer" face, and a so-called "inner" face for fastening against the body, and the body comprises a so-called "outer" face on which the decorative element comes to bear, and a so-called "inner" face on the side of which the stem forcibly bears.

In the three preceding embodiments, the stem forcibly bears on a bearing surface borne by a bearing stud integral with the body, or on a bearing stud integral with the decorative element.

According to a fourth embodiment, illustrated in FIGS. 19 to 23, the stem borne by the decorative element 600 forcibly bears on a bearing surface 740-741 borne directly by the body 700 (on the inner face) and not borne by a bearing stud.

To do so, the transversal pivot hole 610*a* of the stud 610, intended to receive in rotation the stem 611 and the means for locking 621 the second locking stud 620 are located, in fastening position, at a distance H1 from the bearing surface of the body, in such a way that the stem 611 elastically deforms while forcibly bearing on the bearing surface 740-741 when it is locked in fastening position by the means for reversibly locking 621 the second locking stud 620.

In this fourth embodiment, the locking studs may advantageously have a height less than or equal to the thickness of the body, such that they do not extend beyond the body in fastening position, and the stem 611 deforms elastically against the bearing surface 740 constituted, in the first variant illustrated in FIGS. 19 to 21, by the edge 740*a*-740*b* of the two locking orifices 710-720. The bearing surface here is thus in two separate parts.

This fourth embodiment is particularly advantageous when the inner face of the body is intended to enter into contact with the skin of the user. Only the stem 611 is projecting with respect to the inner face of the body 700.

In a second variant illustrated in FIGS. 22 and 23, the bearing surface 741 of the body 700 has a groove 741*a* for receiving the stem 611 when the latter is locked in fastening position by the reversible locking means 621. In this way, the stem is flush at least in part, that is to say that it does not extend beyond, at least in part, the inner face of the body.

To facilitate the fastening while ensuring that the stem does not extend beyond the groove 741*a*, the latter may comprise at each end, that is to say at the edge of the locking orifice 710-720, a bevelled edge 741*b* and 741*c*.

The groove 741*a* is intended to receive the central part of the stem in such a way that the latter is flush, and the bevelled edges prevent the stem from bending too much when it is forcibly pressed against the bearing surface 741.

The presence of bevelled edges may also be provided in the variant illustrated in FIGS. 19 to 21.

The free end of the stem 611 advantageously has folds delimiting a fastening part 611*a* of the stem intended to cooperate with the fastening means 621 of the fastening stud 620 arranged (for example at a height H1) under the bearing surface 740-741, and a gripping part 611*b* intended to be seized by the user to fasten/unfasten the stem 611.

This fourth embodiment also advantageously provides the use of an intermediate stud 630 for translationally and rotationally locking, borne by the decorative element, and intended to be inserted into an intermediate orifice 730 (through orifice or not) borne by the body. This stud does not ensure any locking function of the stem, unlike the three embodiments described previously.

This stud is particularly useful in this embodiment, because the orifice 610 and 620 generally must have dimensions greater than that of the locking studs in order to leave the stem room to pivot and to press against the bearing surface 740-741 borne by the body without risking damaging the stem. These locking orifices thus cannot ensure a precise positioning of the decorative element.

To ensure this function, the intermediate orifice 730 has a cylindrical polyhedral shape (for example triangular, square, rectangular, hexagonal, etc.) and non-circular, complementary to the shape of the intermediate stud, and a dimension that is just superior in order to limit lateral play between the intermediate stud and the orifice. In this way, the decorative element is translationally but also rotationally locked with respect to the body 700. The forcible fastening of the stem finally locks the decorative element on the body.

This enables a very precise reversible fastening in position of the decorative element on the body of the decorative object, while enabling an easy change of the decorative element.

The fastening position of the decorative element is thus precise because it is determined by the cooperation of the intermediate stud and the intermediate orifice. In other words, the user does not have to be concerned with alignment when fastening the decorative element on the body of the decorative object in order that the decorative element is in the position prescribed by the manufacturer.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

The invention claimed is:

1. A decorative object comprising:

a body comprising a first locking orifice and a second locking orifice;

a rigid stem, a decorative element configured for reversibly fastening to the body, the decorative element comprising a first locking stud having a transversal pivot hole through which is pivotably mounted the rigid stem about an axis of rotation defined by the pivot hole, the decorative element further comprising a second locking stud provided with a means for reversibly locking the rigid stem in a fastening position; wherein the first locking orifice is configured to receive the first locking stud of the decorative element and the second locking orifice is configured to receive the second locking stud of the decorative element; and, a bearing surface being arranged, in the fastening position, between the first locking stud and the second locking stud such that the stem forcibly bears on the bearing surface when said stem is locked in the fastening position by the means for reversibly locking the rigid stem in the fastening position.

2. The decorative object according to claim 1, in which the body further comprises the bearing surface.

3. The decorative object according to claim 2, in which the bearing surface of the body has a groove for receiving the stem when the stem is locked in the fastening position by the reversible locking means, in such a way that the stem is flush with an inner surface of the body.

4. The decorative object according to claim 1, in which the bearing surface comprises a bearing stud arranged, in the fastening position, between the first locking stud and the second locking stud and aligned therewith, and on which the stem is intended to bear forcibly when the stem is locked in the fastening position by the means for reversibly locking the second locking stud.

5. The decorative object according to claim 4, in which the bearing stud is integral with the decorative element of the decorative object and arranged between the first locking stud and the second locking stud and aligned therewith, the body comprising an intermediate orifice intended to receive the bearing stud, the intermediate orifice being arranged between the first locking orifice and the second locking orifice and aligned therewith.

6. The decorative object according to claim 4, in which the bearing stud is integral with the body of the decorative object and arranged between the first locking orifice and the second locking orifice and aligned therewith.

7. The decorative object according to claim 4, in which the bearing stud has a height (H) such that the stem is elastically deformed on the bearing stud when the stem is engaged in the means for reversibly locking the rigid stem in the fastening position.

8. The decorative object according to claim 4, in which the bearing stud further comprises a groove for laterally maintaining the stem when the stem bears on the bearing stud.

9. The decorative object according to claim 1, in which the stem has a rectilinear part provided with a free end, and a fastening part pivoting on the first locking stud, said pivoting part being constituted by at least one lateral offset segment forming an angle with respect to the rectilinear part; a segment of axis of rotation emerging from the at least one lateral offset segment and perpendicularly to the rectilinear part; and a locking segment emerging perpendicularly from the segment of axis of rotation.

10. The decorative object according to claim 1, in which the stem is constituted of a strand bent back on itself, so as to form a reversible fastening loop on the second locking stud, each free end of the strand being pivotably fastened on a portion of the first locking stud.

11. The decorative object according to claim 1, in which the rigid stem comprises, between a free end, and a pivoting fastening part, two elbows that are the reverse of each other.

12. A decorative object according to claim 1, further comprising a second decorative element, wherein the second decorative element differs in appearance from the decorative element.

13. A method for assembling a decorative element of a decorative object according to claim 1, comprising:

a) freeing the stem of the locking means from the second locking stud;

b) engaging a free end of the stem in one of the locking orifices of the body;

c) engaging the first locking stud and the second locking stud in the first locking orifice and the second locking orifice of the body until the decorative element is drawn against the body;

d) pivoting the stem towards the second locking stud in such a way that the stem bears on the bearing surface;

e) elastically deforming the stem on the bearing surface to engage the stem in the locking means of the second locking stud.

* * * * *